United States Patent [19]

McCullagh

[11] 4,038,553

[45] July 26, 1977

[54] RADIATION SHIELDING APPARATUS

[76] Inventor: Ralph J. McCullagh, 11221 NW. 43rd St., Coral Springs, Fla. 33065

[21] Appl. No.: 717,111

[22] Filed: Aug. 24, 1976

[51] Int. Cl.[2] ..... G21F 3/04

[52] U.S. Cl. ..... 250/517; 52/410

[58] Field of Search ..... 250/517, 515; 52/410

[56] References Cited

U.S. PATENT DOCUMENTS 3,231,451 1/1966 Gazelle ..... 250/517

*Primary Examiner*—Harold A. Dixon

*Attorney, Agent, or Firm*—Robert D. Farkas

[57] ABSTRACT

This disclosure pertains to a clamping apparatus having a stud capturing portion and a stud facing portion bolted together so as to compressively support a radiation proof sheet material, such as lead sheeting, there-in-between. The interior wall covering material, such as panelling or wall board is secured to the external surface of the stud facing portion. No nails are required to support the radiation-proof sheeting material, thereby minimizing accidental leakage due to harmful radiation passing through openings inadvertently disposed in the radiation-proof sheeting in the conventional nail securing supporting thereof. A pair of radiation-proof tracks capture the free ends of the stud capturing portion and the stud facing portion.

6 Claims, 2 Drawing Figures

RADIATION SHIELDING APPARATUS

BACKGROUND OF THE INVENTION

1. The Field of the Invention

This invention relates to apparatus utilized in the construction of enclosures, such as rooms, whose walls preclude the passage of harmful electromagnetic radiation, such as X-rays.

2. Description of the Prior Art

The prior art abounds with apparatus useful in the construction of walls impervious to the transmission of X-rays therethrough. U.S. Pat. No. 2,720,105 issued on Oct. 11, 1955 to J. O. Billups teaches a wall construction utilizing lead-filled bricks or blocks interlocked to each other utilizing dovetail marginal edges. Such a construction results in a heavy wall cross-section which requires exterior and interior finished wall board surfaces to provide a finished pleasing construction. The cost of such walls is excessive and frequently requires external vertical support columns to maintain the wall in vertical alignment.

U.S. Pat. No. 1,815,922 issued on July 28, 1931 to S. Lapof discloses a composite of a lead layer adhered to one side of a wall covering board, overcoming the need to fasten such layers together in the field. A strip of lead material is utilized as a lath extending along the length of each stud's facing area and horizontally between studs, so as to overlap joints formed by adjacent sheets of lead covered wallboard. Nails, protruding through the wallboard and the lath-like stud facings, secure the composite wallboard to the studs. This invention requires the handling of heavy composite wallboard sheets and does not preclude occasional leakage paths piercing the lead covering of the wallboard or the lead lathing strips.

The present invention permits lead sheeting to be installed on the surface of studs without creating a plurality of holes therein, thereby permitting the erection of a lightweight radiation-proof wall.

SUMMARY OF THE INVENTION

A primary object of the present invention is to provide a lead sheet supporting apparatus which does not require the use of nails or other piercing type fasteners to form openings in the lead sheet.

Another object of the present invention is to provide a metallic jacket which when combined with a lead sheet abutting thereto, substantially encapsulates a wooden stud.

Still another object of the present invention is to provide a lead sheet stud facing portion which can effectively bridge an abutting or overlapping joint in the lead sheets affixed to the stud there-behind.

Present day hospital X-ray rooms or X-ray rooms utilized in laboratories, physicians' and dentists' offices are frequently constructed utilizing thin lead sheets disposed against the studs along the innermost marginal edges of the walls comprising an X-ray radiation-proof room. The low cost and relatively lightweight of the lead sheeting has resulted in its increased popularlity. However, great care must be exercised in the erection of the sheet so as to prevent cracks or openings to be formed therein. The piercing of the sheet by nails, utilized to support it to the studs forming the wall oftentimes results in protrusions, caused by the heads of the fastening nails, to extend inwardly into the rooms, interfering with the installation of a wallboard covering such as plasterboard or wood panelling to be affixed thereto. Should the nails, used to support the wallboard material contact the nails used to support the lead sheeting, a tearing action may occur in areas of the lead sheeting adjacent the heads of the nails fastening it to the studs, requiring expensive repairs or, if the installer in unaware of such a tearing action, resulting in a leakage path for X-ray radiation generated within the room.

The present invention overcomes these objections by providing a stud capturing portion having a pair of inwardly turned edges disposed against the surface of the stud destined to support the lead sheeting. The lead sheeting is placed against the inwardly turned edges and clamped thereto by a stud facing portion, which in turn is bolted to the stud capturing portion. Wallboard is fastened to the exterior face of the stud facing portion, utilizing any convenient fastening means therefor. Ceiling panels having radiation-proof properties may be supported in conventional fashion so as to protect the ceiling area from the transmission of harmful X-ray radiation.

These objects, as well as other objects of the present invention, will become more readily apparent after reading the following description of the accompanying drawings.

DESCRIPTION OF THE PREFERRED EMBODIMENT

The structure and method of fabrication of the present invention is applicable to a U-shaped member, having inwardly turned flange-like legs at the free ends thereof, and having a length substantially equal to the length of the wooden studs comprisinng the wall supporting elements of an X-ray proof room, is installed about each stud having the inwardly turned flange-like legs disposed on the surface of the stud defining the interior of the room. Both the stud and the stud capturing portion having the ends thereof locked within the legs of a pair of opposed U-shaped tracks, reside at the floor and ceiling levels of the room. Lead sheeting, having a height somewhat shorter than the height of the stud and stud capturing element there-around, is disposed in parallel abutting relationship with the inwardly turned legs of the stud capturing portion. A stud facing element, having a U-shaped cross-section and a pair of arms extending outwardly along the leg portions thereof is clamped against the innermost surface of the lead sheeting, so as to have the arms grasp the sides of the stud capturing element, adjacent the upper ends thereof. Bolts passing through the arms engage the side walls of the stud capturing element, securing the stud facing element thereto. The lowermost and apparent marginal edges of the stud facing element are captured between the legs of the lowermost and uppermost tracks, thereby locking the lead sheeting beween the surface of the inwardly turned legs of the stud capturing element and the marginal edges of the legs of the stud facing element.

The legs of the stud facing element are preferably constructed so as to provide a cavity in the stud facing element, whose minimal depth is somewhat greater than the thickness of the lead sheeting. Thus, overlapping joints can be fabricated on the innermost face of the stud that is exposed intermediate the free marginal edges of the inwardly turned flange-like legs of the stud capturing element. The double thickness, found at such an overlapping joint, resides within the cavity, including any portions, such as nail heads of the fastening devices utilized in fabricating the overlapping joint.

Wallboard, such as dry wall or panel board, may be secured to the outermost surfaces of the stud facing element utilizing adhesives therefor. If it is desired to utilize nails, the stud facing element may be fabricated from fiber-filled plastic materials, such as glass fibers impregnated with a bonding resin. Such construction of the stud facing element is permissible since the principle functions thereof are to clampingly support the lead sheeting to the stud and to provide a mounting surface for the wallboard, rather than provide an additional boundary layer, impervious to X-ray transmission therethrough. The stud capturing element may be fabricated from metal or from a similar plastic composite material to that of the stud facing element, if so desired.

Figure 1:
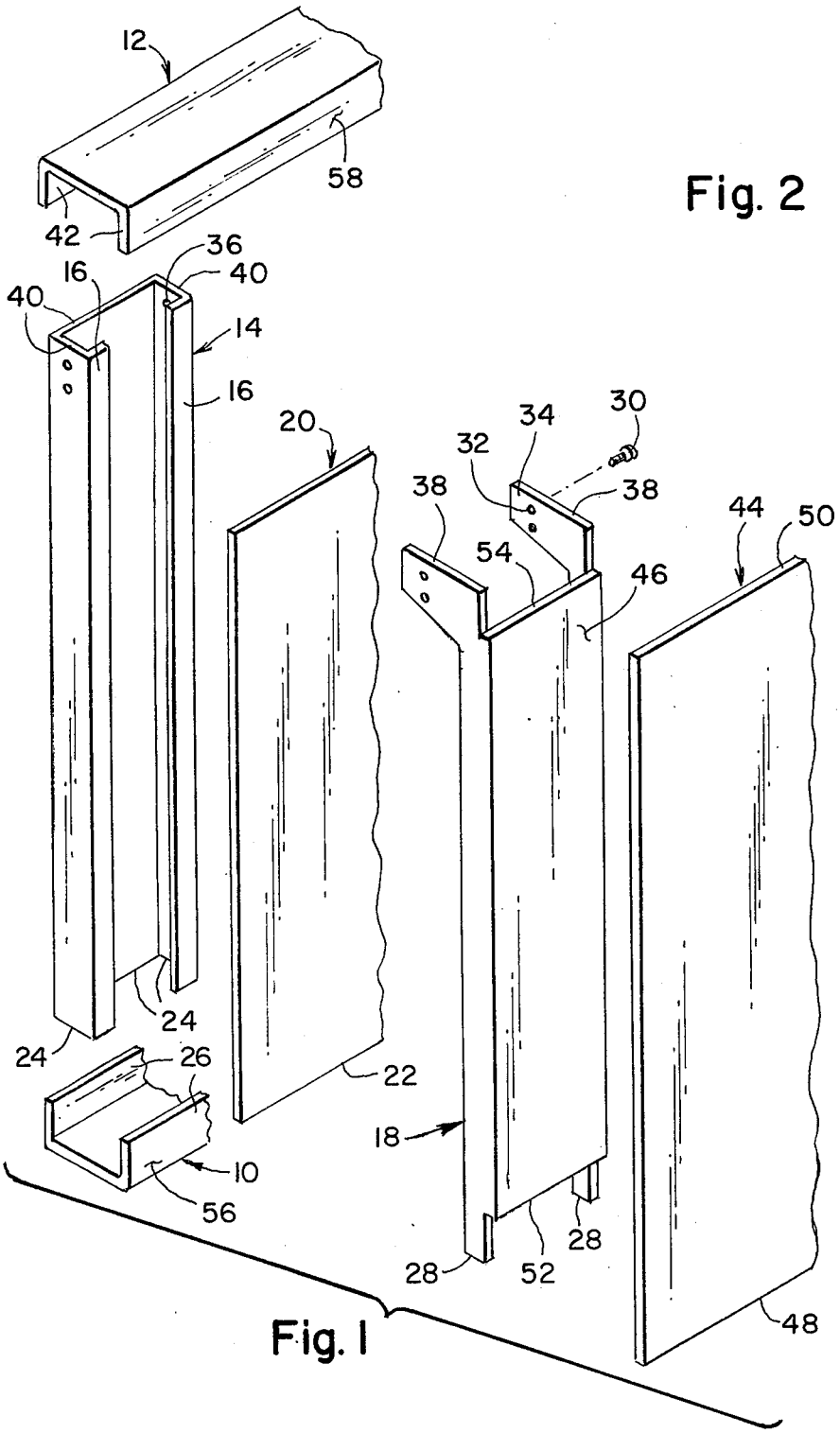
FIG. 1 is an exploded perspective view of the elements of the present invention, including a section of lead sheeting and a section of wallboard covering.

Now referring to the Figures, and more particularly to the embodiment illustrated in FIG. 1 showing a bottom U-shaped track element 10 and showing a top U-shaped track element 12. Stud capturing element 14 is shown having a pair of inwardly turned flanges 16 at the free ends of the otherwise U-shaped cross-section. A stud, not shown, of wood, may if desired, pass through the interior confines of stud capturing element 14 for use in joining free edges of adjacent lead sheets in abutting clamping relationship thereto, if desired. Such a stud is not necessary when the structural strength of stud capturing element 14 and stud facing element 18, to be affixed thereto, possesses adequate structural strength. Lead sheeting 20 is installed abutting the exterior surfaces of flange-like legs 16 having the lowermost marginal edges 22 and 24 thereof, respectively, residing within the side walls 26 of bottom track 10. In similar fashion, lowermost edges 28 of stud facing element 18 resides within side walls 26. Bolt 30 passes through hole 32 disposed in arm 34 and engages threaded hole 36 in stud capturing element 14, securing the uppermost marginal edges 38 of stud facing element 18 in the same plane formed by uppermost marginal edges of stud capturing element 14. Top track 12 has the leg portions 42 thereof disposed downwardly so as to capture marginal edges 38 and 40 there-in-between. Wallboard material 44 is fixedly secured to the outermost surface 46 of stud facing element 18 having the lowermost marginal edge 48 and the uppermost marginal edge 50 thereof disposed adjacent the lowermost portion and the uppermost portion of track elements 10 and 12 respectively. Notches 52 and 54, disposed at the uppermost and lowermost ends of stud facing element 18 permit surface 46 to lie in the same plane as surfaces 56 and 58 of bottom track and top track 10 and 12 respectively when stud facing element 18 is installed within legs 26 and 42 thereof.

Figure 2:
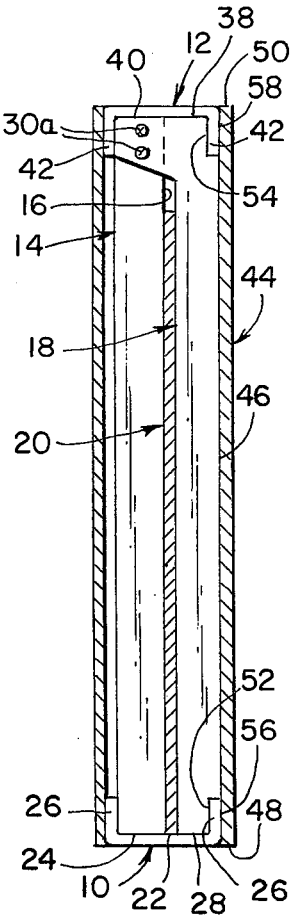
FIG. 2 is a side elevation view of the assembled components illustrated in FIG. 1.

FIG. 2 illustrates bottom track 10 and top track 12 shown capturing lowermost marginal edges 24, 22, and 28 and uppermost marginal edges 40 and 38. Lead sheet 20 is shown captured between stud capturing element 14 and stud facing element 18. Bolts 30*a* secure stud facing element 18 to stud capturing element 14 before top track 12 is installed so as to conceal uppermost marginal edges 38 and 40.

One of the advantages of the present invention is a lead sheet supporting apparatus which does not require the use of nails or other piercing type fasteners to form openings in the lead sheet.

Another advantage of the present invention is a metallic jacket which when combined with a lead sheet abutting thereto substantially encapsulates a wooden stud.

Still another advantage of the present invention is a lad sheet stud facing portion which can effectively bridge an abutting or overlapping joint in the lead sheets affixed to the stud there-behind.

Thus, there is disclosed in the above description and in the drawings, an embodiment of the invention which fully and effectively accomplishes the objects thereof. However, it will become apparent to those skilled in the art, how to make variations and modifications to the instant invention. Therefore, this invention is to be limited, not by the specific disclosure herein, but only by the appending claims.

The embodimennt of the invention in which an exclusive privilege or property is claimed are defined as follows.

I claim:

1. A radiation shielding apparatus comprising a pair of U-shaped tracks, a first element having a U-shaped cross-section and a pair of inwardly turned flanges fixedly secured to the free longitudinal edges thereof, a second element having a U-shaped cross-section and a pair of arms extending the length of the legs of said U-shaped cross-section, said pair of arms fixedly secured to said legs adjacent one end of said second element, means to removably fasten said pair of arms to portions of said first element adjacent one end thereof, means to clampingly secure lead sheeting between said first element and said second element, means to confine said one end of said first element and said one end of said second element within one of said pair of U-shaped tracks, means to confine the other end of said first element and the other end of said second element within the other of said pair of U-shaped tracks.

2. The radiation shielding apparatus as claimed in claim 1 further comprising means to dispose an exterior surface of said second element in a plane, said plane defined by an exterior surface of each of said pair of U-shaped tracks.

3. The radiation shielding apparatus as claimed in claim 1 further comprising a wooden stud disposed along the length and confined within said U-shaped cross-section and said pair of inwardly turned flanges of said first element.

4. The radiation shielding apparatus as claimed in claim 2 further comprising a wallboard fixedly secured to said second element at a surface thereof being disposed at said plane.

5. The radiation shielding apparatus as claimed in claim 1 wherein said second element comprises a non-metallic resin impregnated fibrous material.

6. The radiation shielding apparatus as claimed in claim 1 wherein said fastening means comprises at least one hole in one of said pair of arms, a bolt, a threaded opening disposed adjacent one of said pair of inwardly turned flanges at said one end of said first element, said bolt being disposed passing through said one hole and threadingly engaging said threaded opening.

* * * * *